United States Patent [19]

Ganeff et al.

[11] Patent Number: 4,579,539

[45] Date of Patent: Apr. 1, 1986

[54] BREAKDANCE DOLL

[76] Inventors: Joseph M. Ganeff, 1900 California St., #17, Mountain View, Calif. 94040; Matthew G. Morris, 124 Sunset, Sunnyvale, Calif. 94086

[21] Appl. No.: 709,412

[22] Filed: Mar. 7, 1985

[51] Int. Cl.[4] ..... A63H 11/10

[52] U.S. Cl. ..... 446/289; 446/484

[58] Field of Search ..... 446/289, 268, 269, 353, 446/352, 270, 272, 278, 288, 290, 291, 324, 484

[56] References Cited

U.S. PATENT DOCUMENTS 112550 3/1871 Clay ..... 446/354

3,029,552 4/1962 Katz ..... 446/353

FOREIGN PATENT DOCUMENTS 672206 10/1964 Italy ..... 446/354

*Primary Examiner*—Mickey Yu

*Attorney, Agent, or Firm*—Willis E. Higgins

[57] ABSTRACT

A breakdance doll (10) has a body (11) having a back (12), buttocks (13), and a neck (38) joining a head (40) to the body (11). The back (12) has a laterally extending slot (24) positioned between chest height and the buttocks (13). A rotatable drive wheel (22) extends from the slot (24) and is connected to a motor (26) mounted in the body (11) above the slot (24) by shaft (28). The motor (26) and a battery (36) are positioned to provide a suitable weight distribution for the doll (10), so that the doll (10) will pivot about a point (16) on the back (12) above the slot (24) as the drive wheel (22) rotates.

12 Claims, 3 Drawing Figures

BREAKDANCE DOLL

BACKGROUND OF THE INVENTION

1. Field of the Invention

This invention relates to a new form of doll which will execute a characteristic breakdance move. More particularly, it relates to such a doll that will spin on its back in the same manner as an accomplished breakdancer. Most especially, it relates to such a doll incorporating a simple mechanism and incorporation of the mechanism into the doll for producing a spin breakdance move.

2. Description of the Prior Art

Over the years, a wide variety of mechanisms have been incorporated in dolls and other toys for the purpose of producing motion of the dolls or parts of their bodies. Such moving dolls and toys have always had substantial public appeal for amusement of both children and adults, since at least the Middle Ages, when such devices were widely incorporated in public clocks, usually located in town squares, and in elaborate clockwork constructions for entertaining the nobility at court. More recently, such movable dolls and toys have been and continue to be mass produced for sale at low prices. Representative, but by no means exhaustive, examples of such dolls and toys may be found in the following issued U.S. Patents: U.S. Pat. Nos. 156,660, issued Nov. 10, 1874 to Clay; 3,494,068, issued Feb. 10, 1970 to Crosman; 3,500,577, issued Mar. 17, 1970 to Bart; 3,512.300, issued May 19, 1970 to Thoresen; 4,300,308, issued Nov. 17, 1981 to Ikeda; 4,312,150, issued Jan. 26, 1982 to Terzian; 4,363,187, issued Dec. 14, 1982 to Shinohara; 4,386,479, issued June 7, 1983 to Terzian et al; 4,419,841, issued Dec. 13, 1983 to Huang. Similar in operation to the walking toys disclosed in the Thoresen patent are the widely sold mechanical ladybug toys, which exhibit an erratic spinning motion.

Breakdancing is a recent phenomenon, in which the performer executes a variety of athletic dance moves, usually to music supplied by a cassette tape player. In one of the characteristic breakdance moves, the dancer spins by pivoting on his or her back. While the mechanisms disclosed in the above prior art are capable of emulating a wide variety of body movements, none of them are capable of imitating this breakdance routine.

SUMMARY OF THE INVENTION

Accordingly, it is an object of this invention to provide a doll incorporating a mechanism that will cause the doll to imitate a breakdance spin move.

It is another object of the invention to provide a mechanism and a mounting for the mechanism that will balance a doll properly for executing such a breakdance spin move.

It is a further object of the invention to provide a simplified spinning mechanism for a doll which provides a realistic imitation of such a breakdance spin move.

The attainment of these and related objects may be achieved with the novel mechanized doll of this invention. A doll in accordance with this invention has a back having a laterally extending slot positioned between chest height and the buttocks. A rotatable drive wheel extends from the slot and is connected to a drive means, such as a miniature electric motor, mounted in the doll above the slot. When implemented with an electric motor as the drive means, a battery for powering the motor is desirably positioned above the motor, extending from the neck into the head of the doll. Such an arrangement of the drive mechanism above the slot provides a proper balance for the doll, so that it will pivot about a point on the back above the slot as the drive wheel rotates. While the doll will pivot in an imitation of the breakdance spin move on essentially any flat, hard surface, such a surface is desirably provided with the doll in the form of a breakdance board, scaled to the size of the doll.

A doll incorporating this simple mechanism and construction will execute the breakdance spin move in a realistic fashion. The doll can be mass produced at very low cost and can include a variety of accessories to lend realism to its performance.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
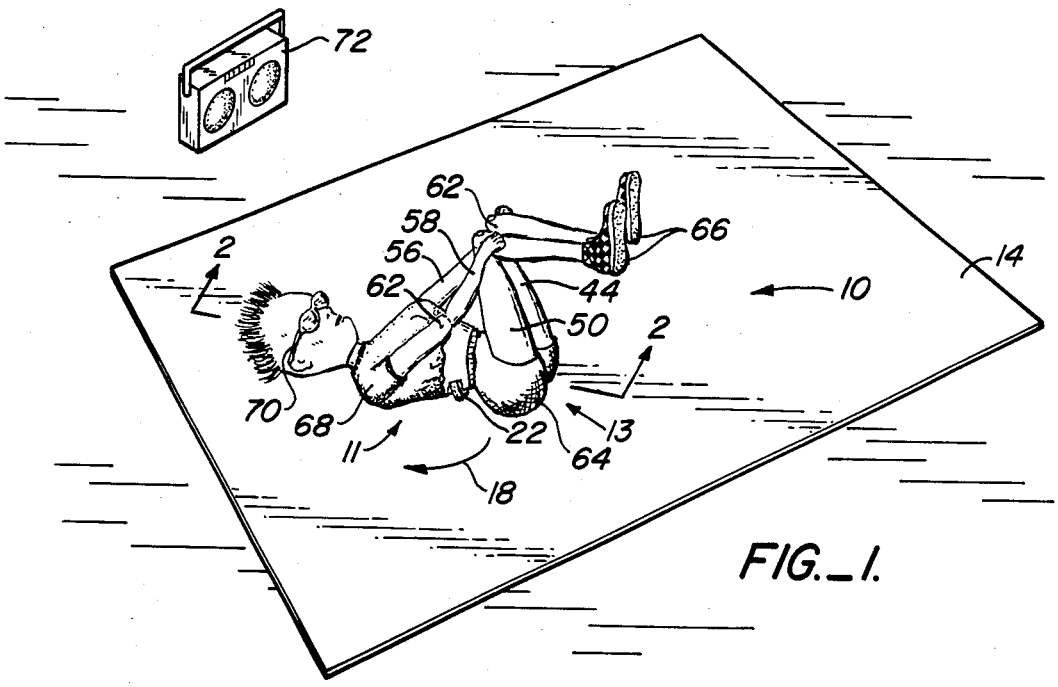
FIG. 1 is a perspective view of a doll in accordance with the invention in operation.
Figure 2:
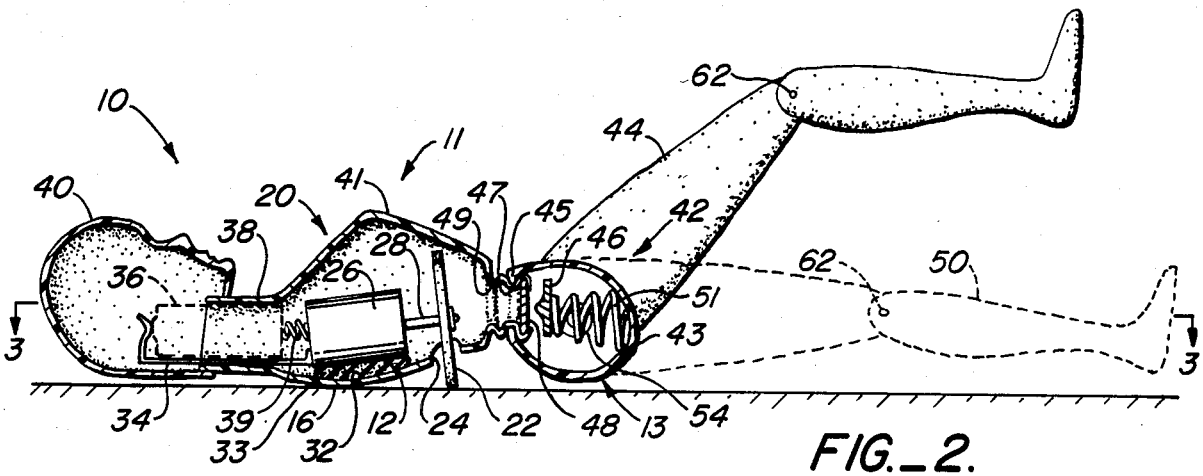
FIG. 2 is a cross-section view, taken along the line 2—2 in FIG. 1.
Figure 3:
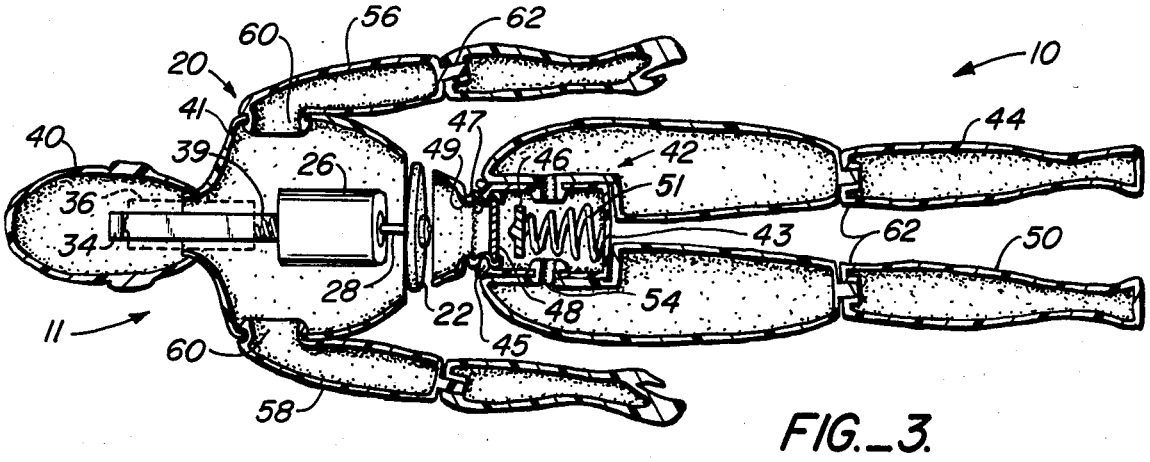
FIG. 3 is another cross-section view, taken along the line 3—3 in FIG. 2.

Turning now to the drawings, more particularly to FIGS. 1-3, there is shown a doll 10 in accordance with the invention, having a body 11. The doll is in position on its back 12, on a smooth, flat and hard breakdance board 14, executing a breakdance spin move. During this move, the doll 10 pivots around point 16 on its back, as indicated by the arrow 18.

Details of mechanism 20 for causing the doll 10 to execute the spin move are shown in FIGS. 2 and 3. Roller 22 protrudes from slot 24 between point 16 and buttocks 13 in back 12 of the doll 10. As is best shown in FIG. 2, the roller 22 extends from the back 12 of the doll so that it is even with the pivot point 16, higher up on the back 12. Roller 22 is rotatably attached to motor 26 by shaft 28. In practice, the motor 26 is desirably implemented with a Model FA130, obtainable from Cermag Aristocraft. The motor 26 is fixedly attached to the inside surface 32 of the back 12 with a suitable adhesive 33, such as hot glue. A conductive clip 34 for battery 36 extends from the motor 26 through neck 38 and into head 40 of the doll 10. A spring 39 is disposed between the motor 26 and the battery 36 to hold the battery in place in the clip 34 and insure reliable contact to the battery. The head 40 is removably attached to neck 38 of the doll by a friction fit, and the head 40 is removed for access to the battery 36. The body 11 of the doll 10 is divided into an upper portion 41 and a lower portion 43. Lower portion 43 has an encircling projection 45, which engages mating grooves 47 and 49 on the upper portion 41 to fasten the upper portion 41 and the lower portion 43 together in two different positions. A switch 42 is built into the upper and lower body portions 43 and 45 of the doll. When the projection 45 engages groove 49, contacts 46 and 48 of the switch 42 are brought into engaging position, so that the circuit including the battery 36 and the motor 26 is completed.

Contact 46 is mounted on spring 51. Alternatively, a conventional miniature switch could be employed in the circuit, positioned on the side of the doll or other location where it would tend not to be visible during operation of the doll and therefore detract from its realism. The legs 44 and 50 of the doll are pivotally fastened to torso 52 of the doll at 54. Similarly, the arms 56 and 58 are pivotally fastened to the torso 52 at 60. The arms 56 and 58 and the legs 44 and 50 are jointed at 62 in order to allow increased realism in posing the doll. Shorts 64, sneakers 66, shirt 68, glasses 70, a non-functional cassette player 72, and similar accessories may also be provided with the doll to increase its realism.

In operation, the roller 22 will rotate the doll at up to about 1 revolution per second when the doll is placed on a hard surface, such as the breakdance board 14 and the switch 42 closed. To close the switch 42, the user presses the upper and lower body portions 41 and 43 together, so that projection 45 engages groove 49 and the contacts 46 and 48 engage one another to complete the circuit. To turn the doll off, the upper and lower body portions 41 and 43 are pulled apart, so that projection 45 engages groove 47 and the contacts 46 and 48 are apart. It is important that the doll 10 have its weight distributed so that the doll will pivot about the point 16 on the back of the doll in order to provide the proper motion. This motion duplicates the corresponding breakdance move very realistically.

It should now be readily apparent to those skilled in the art that a novel mechanized doll capable of achieving the stated objects of the invention has been provided. The mechanism distributes the weight of the doll properly for duplicating a breakdance spin move and is simple in construction.

It should further be apparent to those skilled in the art that various changes in form and detail of the invention as shown and described may be made. For example, a windup mechanism could be substituted for the motor 26 and battery 36. It is intended that such changes be included within the spirit and scope of the claims appended hereto.

What is claimed is:

1. A breakdance doll, comprising a body having a back, buttocks, and a neck joining a head to said body, said back having a laterally extending slot positioned between chest height and said buttocks, a rotatable drive wheel extending from the slot and operatively connected to a drive means mounted in said body between said neck and the slot, said drive means being positoned to provide a suitable weight distribution for said doll, so that said doll will pivot about a point on said back between said neck and the slot as said drive wheel rotates and said doll supported on its back on a support surface.

2. The breakdance doll of claim 1 in which said drive means is an electric motor, a battery for powering said motor being positioned between said motor and said head, extending from said neck into said head of said doll, and said head is removably attached to said neck.

3. The breakdance doll of claim 1 additionally comprising a pair of arms and a pair of legs pivotally attached to said body.

4. The breakdance doll of claim 3 in which said pair of arms is formed from an upper arm and a lower arm pivotally connected to the upper arm, and said pair of legs is formed from an upper leg and a lower leg pivotally connected to the upper leg.

5. The breakdance doll of claim 4 in which said body has an upper and a lower part, said upper and lower parts being attachable to each other in a first position and a second position, said upper part having a first electrical contact mounted thereon, said lower part having a second electrical contact mounted thereon, so that moving said upper and lower parts to the first position causes said first and second electrical contacts to engage and moving said upper and lower parts to the second position causes said first and second electrical contacts to be separated, said first and second electrical contacts being connected as a switch in an electrical circuit with said drive means.

6. The breakdance doll of claim 1 in combination with a board having a smooth, flat and hard surface dimensioned and configured to accomodate said breakdance doll while pivoting about the point on said back between said neck and the slot as said drive wheel rotates in contact with said board surface.

7. A mechanized doll, comprising a body having a back, buttocks, and a neck joining a head to said body, said back having an aperture positioned between chest height and said buttocks, a rotatable drive member extending from said back at the aperture and operatively connected to a drive means mounted in said body between said neck and the aperture, said drive means being positioned to provide a suitable weight distribution for said doll, so that said doll will pivot about a point on said back between said neck and the aperture as said drive member rotates and said doll supported on its back on a support surface.

8. The mechanized doll of claim 7 in which said drive means is an electric motor, a battery for powering said motor being positioned between said motor and said head, extending from said neck into said head of said doll, and said head is removably attached to said neck.

9. The mechanized doll of claim 7 additionally comprising a pair of arms and a pair of legs pivotally attached to said body.

10. The mechanized doll of claim 9 in which said body has an upper and a lower part, said upper and lower parts being attachable to each other in a first position and a second position, said upper part having a first electrical contact mounted thereon, said lower part having a second electrical contact mounted thereon, so that moving said upper and lower parts to the first position causes said first and second electrical contacts to engage and moving said upper and lower parts to the second position causes said first and second electrical contacts to be separated, said first and second electrical contacts being connected as a switch in an electrical circuit with said drive means.

11. The mechanized doll of claim 8 in which said pair of arms is formed from an upper arm and a lower arm pivotally connected to the upper arm, and said pair of legs is formed from an upper leg and a lower leg pivotally connected to the upper leg.

12. The mechanized doll of claim 7 in combination with a board having a smooth, flat and hard surface dimensioned and configured to accomodate said breakdance doll while pivoting about the point on said back between said neck and the aperture as said drive member rotates in contact with said board surface.

* * * * *